United States Patent [19]

Biesinger et al.

[11] 4,207,638

[45] Jun. 17, 1980

[54] DRY-CLEANING METHOD AND ARRANGEMENT

[75] Inventors: Erwin Biesinger; Eckard Möllendorf, both of Rottenburg, Fed. Rep. of Germany

[73] Assignee: Seco Maschinenbau GmbH & Co KG, Rottenburg, Fed. Rep. of Germany

[21] Appl. No.: 870,573

[22] Filed: Jan. 18, 1978

[30] Foreign Application Priority Data

Feb. 1, 1977 [DE] Fed. Rep. of Germany ..... 2704020

[51] Int. Cl.[2] ..... D06F 29/02

[52] U.S. Cl. ..... 8/150; 68/18 F; 68/20; 68/210

[58] Field of Search ..... 68/210, 18 R, 18 F, 68/19.2, 20; 34/236; 8/150

[56] References Cited

U.S. PATENT DOCUMENTS 2,659,224 11/1953 Duncan ..... 68/210 X

FOREIGN PATENT DOCUMENTS 467594 6/1937 United Kingdom ..... 68/210

*Primary Examiner*—Philip R. Coe

*Attorney, Agent, or Firm*—Michael J. Striker

[57] ABSTRACT

A cleaning chamber and a separate spaced-apart drying chamber are provided, which communicate with one another. Articles are cleaned in the cleaning chamber while the same is out of communication with the drying chamber. Then the communication between the chambers are established and the cleaned articles are transported from the cleaning chamber into the drying chamber with a stream of air circulating in a closed path. After this, the communication between the chambers is interrupted and the thus-transported articles are dried in the drying chamber. A transport conduit communicates the chambers with one another, and a flap located in the former is operative for closing and opening the transport conduit. An air passage additionally communicates the chambers with one another, and an air impeller causes air to travel into the cleaning chamber to thereby transport the articles from the same, and to travel into the drying chamber to thereby dry the articles.

25 Claims, 4 Drawing Figures

FIG. 1
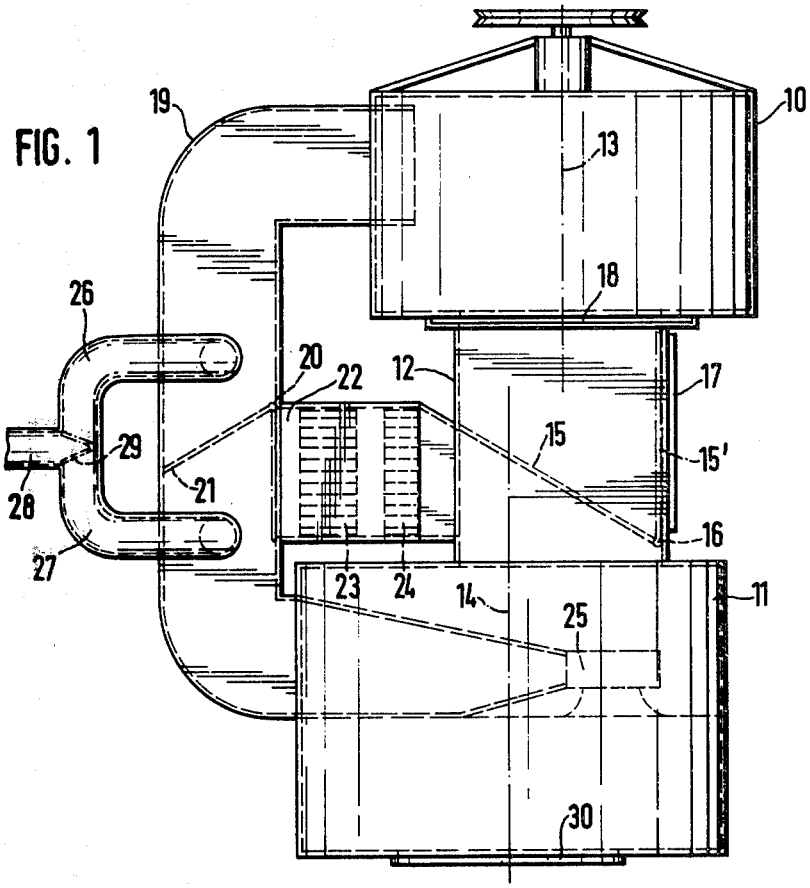
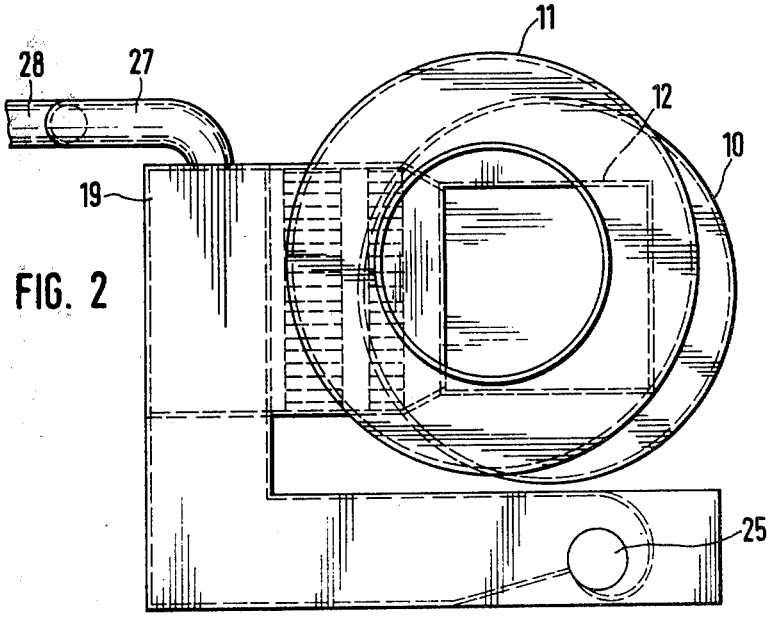
FIG. 2

FIG. 3
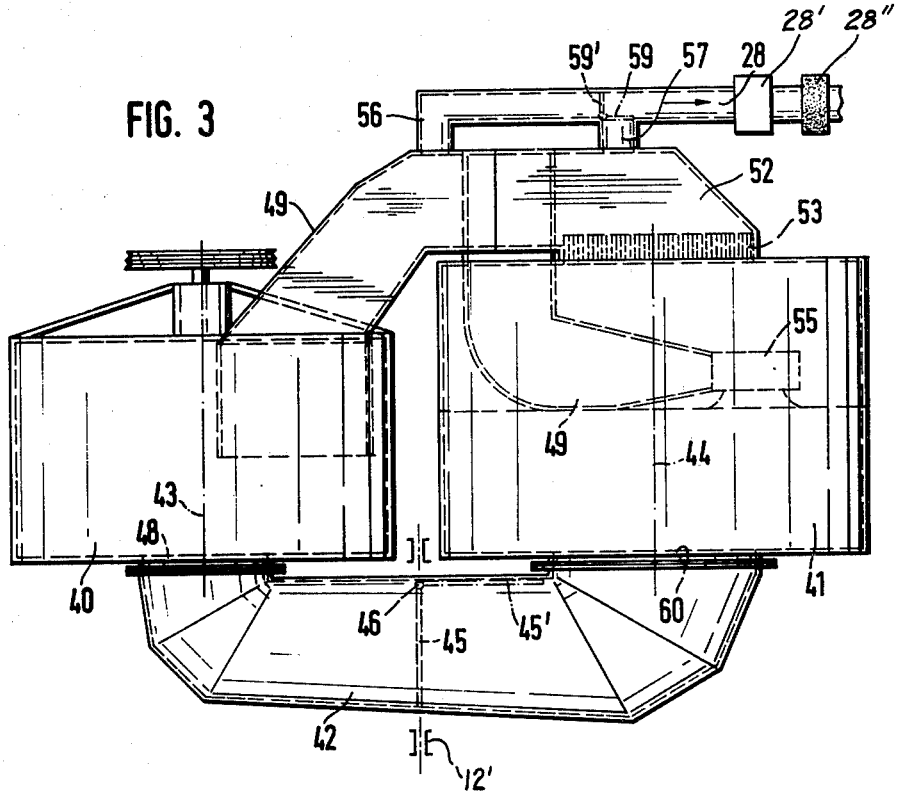
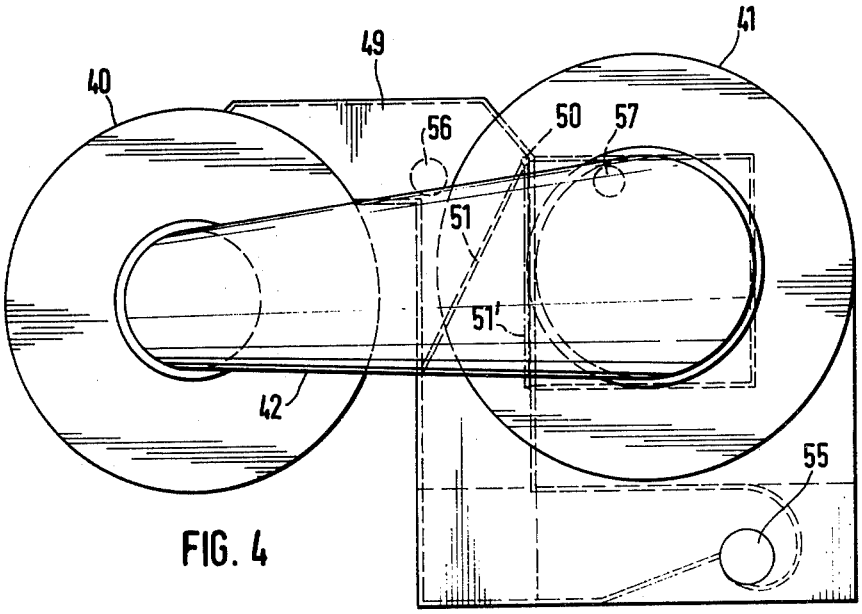
FIG. 4

DRY-CLEANING METHOD AND ARRANGEMENT

BACKGROUND OF THE INVENTION

The present invention relates to a dry-cleaning method and arrangement.

Dry-cleaning methods and arrangements are well-known. In the known arrangements articles to be cleaned and dried are admitted into a single chamber formed by a rotatable drum in which both cleaning of dirtied articles as well as subsequent drying of the cleaned articles are performed. The cleaned and dried articles are then withdrawn from the drum. This means that during the process of cleaning the articles cannot be dried, and during the process of drying the articles cannot be cleaned. Therefore, the throughput of the arrangement is limited.

SUMMARY OF THE INVENTION

Accordingly, it is an object of the present invention to provide a dry-cleaning method and arrangement which avoid the disadvantages of the prior art.

More particularly, it is an object of the present invention to provide a dry-cleaning method and arrangement which assures a greater throughput per time unit as compared with the known methods and arrangements.

In keeping with these objects, and with others which will become apparent hereinafter one feature of the present invention resides, briefly stated, in a dry-cleaning method which includes the steps of cleaning and drying articles in separate cleaning and drying chambers and transporting the cleaned articles from the former into the latter by a stream of air circulating in a closed path. The arrangement for performing the proposed method includes means forming the cleaning and drying chambers, means for selectively establishing and interrupting communication between the chambers so as to permit the cleaned articles to be transported from the cleaning chamber into the drying chamber, air inducing means, air passage communicating both of the chambers with the air inducing means, and means for causing a flow of induced air through the air passage into the cleaning chamber where the chambers are in communication with one another so as to transport the cleaned articles from the cleaning chamber into the drying chamber and for causing a flow of induced air to travel in a closed path through the second chamber when the communication between the chambers is interrupted. The invention is constituted not only by the fact that the cleaning and drying of the articles are performed in different chambers but also in the fact that the air which transports the articles from the cleaning chamber to the drying chamber and which also dries the articles, circulates in the closed path so that vapors of a working solution cannot escape from the arrangement.

In accordance with the invention, the articles can be simultaneously cleaned and dried. This is very advantageous, especially for cleaning of very dirtied uniforms which is to be done in several cleaning baths, so that cleaning time and drying time are approximately equal to one another.

The means forming the chambers may be formed as rotatable drums, the communication means may include a transport conduit, and the air inducing means may include an air impeller.

Another feature of the present invention is that the drying chamber has a capacity exceeding the capacity of the cleaning chamber. The proposed method and arrangement improve the drying effect and therefore reduce the time of drying. For these reasons the drying drum can be made larger than the cleaning drum, whereby a greater drop height and a greater capacity for drying of the cleaned articles are provided. During drying the articles can be better fanned, and also easily withdrawn from the drying drum inasmuch as the larger drying drum can be provided with a wider outlet opening as compared with that of the cleaning drum. For the above reasons, the efficiency of the arrangement is improved.

Still another feature of the invention is that the arrangement has means for recovering a cleaning solution, and a flap located in the air passage downstream of the air impeller so that the flow of air is forced to the recovering means. The drums can be located coaxial and axisparallel to one another, or laterally offset relative to one another. In the first case, the transport conduit may extend coaxial or axisparallel to one another, whereas in the second case the transport conduit extends laterally adjacent to the drums and has end portions coaxial with the drums and open thereinto. The transport conduit may be movable relative to the drums, for instance, rotatable about an inlet opening of the drying drum. In such a construction it is additionally possible to mechanically load the articles into the arrangement by means of the transport conduit.

A further feature of the invention is that the transportation of the articles is performed by the flow of air circulating in a closed path with the aid of the air inducing means. The above transportation may be additionally mechanically improved, for instance by rotation of the transport conduit in at least a stepped manner. Movement of the air through the conduit may also be improved by inclining the transport conduit walls.

The arrangement is closed from outside. The transportation of the articles by the flow of induced air is performed in the closed path and the recovery of the solution is also performed in a closed circuit leading to a condenser. A still further feature of the invention is that the arrangement may be provided with an additional air impeller and an activated charcoal filter element coupled therewith, which communicate with the air passage through an additional passage provided with a pivotally mounted flap. The above additional means can build a negative pressure in the cleaning drum during filling the latter with the articles to be cleaned, so that escape of vapors of the solution from the drum is prevented. This means may also operate during unloading of the drying drum by building the negative pressure in the drying drum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a schematic plan view showing an arrangement with two axisparallel drums located one under the other;

FIG. 2 is a schematic side view of the arrangement shown in FIG. 1;

FIG. 3 is a schematic plan view of an arrangement with two axisparallel drums located laterally adjacent to one another in accordance with another embodiment of the present invention; and FIG. 4 is a schematic side view of the arrangement shown in FIG. 3.

DESCRIPTION OF THE PREFERRED EMBODIMENTS

The arrangement for dry-cleaning is shown in FIGS. 1 and 2 and has a rotatable cleaning drum 10 and a rotatable drying drum 11. The drums 10 and 11 are located one above the other, and their axes of rotation 13 and 14, respectively, are parallel to one another. A transport conduit 12 having a quadrangular cross-section communicates the cleaning drum 10 with the drying drum 11. The transport conduit 12 can be closed by a locking flap 15. The locking flap 15 is pivotally movable about a pivot 16 between a closed position shown by solid lines in FIG. 1, and an open position shown in broken lines and identified by reference numeral 15'. In the latter position the locking flap 15 closes an inlet opening 17 of the transport conduit 12. An opening of the cleaning drum 10 which communicates with the transport conduit 12 can be closed by a sliding flap 18.

The cleaning drum 10 additionally communicates with the drying drum 11 through connecting passage 19 provided with a flap 21 which is pivotally movable about an axis 20. An additional passage 22 leads to a schematically shown condenser 23 and a heating arrangement 24 for recovering a solution. The flap 21 is operative for selectively closing either the connecting passage 19 or the additional passage 22.

The connecting passage 19 extends from the drying drum 11 through a blower 25 located under the drying drum, and then above the flap 21 to a chamber formed by the cleaning drum 10. Passages 26 and 27 are provided, which communicate with a suction conduit 28 and are open into the connecting passage 19 at opposite sides of the flap 21. A pivotally movable flap 29 is operative for selectively communicating the suction conduit 28 either with the passage 26 or with the passage 27.

The arrangement shown in FIGS. 1 and 2 operates in the following manner:

After withdrawal of the sliding flap 18, articles to be cleaned, such as textile and similar articles, are fed into the cleaning drum 10 through the inlet opening 17 and the transport conduit 12. The locking flap 15 is located in the position shown in solid lines in FIG. 1 so as to close the transport conduit 12 from the drying drum 11. The pivotal flaps 21 and 29 are located in the positions shown in solid lines in which they lock the passages 19 and 27, respectively. A negative pressure is built in the suction conduit 28 by means of a not shown blower. The suction conduit 28 leads to a not shown activated charcoal filter. Since the blower sucks air into the suction conduit 28 through the connecting passage 19 and the passage 26 during filling of the cleaning drum 10, vapors are prevented from escaping through the inlet opening 17. The sucked air is cleaned in the activated charcoal filter and then can be let out into the atmosphere.

After loading of the cleaning drum 10, the sliding flap 18 is closed and the activated charcoal filter with the blower can be switched off. Several rotatable blades may be provided in the cleaning drum 10. After cleaning and sucking off of the working solution from the cleaning drum 10, the cleaned articles are predried by centrifugation of the solution during fast rotation of the cleaning drum 10.

Subsequent to the centrifugation, the inlet opening 17 is closed by the locking flap 15, as shown in dotted lines and identified by reference numeral 15'. Then the communication between the drying drum 11 and the cleaning drum 10 through the transport conduit 12 is established by withdrawing the slidable flap 18. The blower 25 is switched on, and air is sucked from the chamber of the drying drum 11 and pressed into the connecting passage 19. The pivotal flap 21 is moved into the position shown in dotted lines so as to open the connecting passage 19. The pressed air is forced into the cleaning chamber of the cleaning drum 10 which is provided with perforated walls known per se in the art. Further, the air flows back into the drying drum 11 and transports the cleaned and centrifugated articles from the cleaning drum 10 into the drying drum 11. The transport conduit 12 may have a cross-section increasing in the direction towards the drying drum 11 so as to facilitate the transportation of the cleaned articles.

After the transportation of the cleaned articles the sliding flap 18 of the cleaning drum 10 is closed, the locking flap 15 is moved into its closed position, and the transport conduit 12 is closed. The pivotal flap 21 is moved to the position shown in solid lines and the connecting passage 19 is closed. Air flows from the blower 25 past the flap 21 into the additional passage 22 and then through the condenser 23 and the heating arrangement 24 connected therewith flows back into the drying drum 11. The solution is withdrawn through the above closed circuit and condensed. During the process of drying the cleaning drum 10 can again be filled with new articles in the manner described above, and the process of cleaning can again start. After drying, the drying drum 11 is unloaded through a concentric lower opening 30. During unloading, air can be sucked from the drying drum 11 through the connecting passage 19 and the passage 27 into the suction conduit 28 so as to prevent escape of the solution vapors through the opening 30.

FIGS. 3 and 4 show another embodiment of the present invention. Here, a cleaning drum 40 and a drying drum 41 are located laterally adjacent to one another so that their axes of rotation 43 and 44 are parallel to one another. A transport conduit 42 extends below both drums and is open into concentric openings 48 and 60 of the drums 40 and 41, respectively. The cross-section of the transport conduit 42 increases in the direction from the opening 48 of the cleaning drum 40 towards the opening 60 of the drying drum 41. The transport conduit can be closed by a locking flap 45 pivotally movable about a pivot 46. An additional connecting passage 49 between the drums 40 and 41 extends from the drying drum 41 to the cleaning drum 40 and passes through a blower 55. A flap 51 is also provided pivotally movable about an axis 50, similarly to the embodiment shown in FIGS. 1 and 2. A flow of air generated by the blower 55 can move either in the cleaning drum 40 or in a passage 52 shown in FIG. 3. The passage 52 leads to a condenser 53 and through a not shown heating arrangement into the drying drum 41 so as to form a closed circuit for recovering the solution. Passages 56 and 57 communicate with the connecting passage 49 at opposite sides of the flap 51. These passages lead past a further flap 59 into a suction conduit 28, which latter leads to an air impeller 28' and an activated charcoal filter 28''.

The transport conduit 42 is turnably mounted in a bearing 42' so that it can selectively open the opening 48 of the cleaning drum 40 or the opening 60 of the drying drum 41 for loading or unloading of the arrangement. In addition, by movement of the transport conduit 42 the articles can be mechanically transported after emptying of the cleaning drum 40.

The arrangement shown in FIGS. 3 and 4 operates substantially similarly to that shown in FIGS. 1 and 2. During loading of the cleaning drum 40, the locking flap 45 as well as the flaps 51 and 59 are located in the positions shown in the drawing so as to build a negative pressure in the cleaning drum 40 through the suction conduit 28. During unloading of the arrangement, the negative pressure is built in the drying drum 41 after moving the flap 59 to the position shown in broken lines and identified by reference numeral 59'. In order to unload the cleaned goods after the centrifugation from the cleaning drum 40, the locking flap 45 and the flap 51 are moved to the positions shown in broken lines and identified by reference numerals 45' and 51', respectively. The cleaned goods are transported through the opening 48 of the cleaning drum 40 and through the transport conduit 42 into the drying drum 41 under the action of a strong flow of air supplied by the blower. For drying of the articles, the locking flap 45 and the flap 51 are again moved to their initial positions so that a flow of the induced air passes from the blower through the condenser 53 and the heating arrangement.

In order to unload the arrangement after the termination of the drying process, the transport conduit is turned about the opening 48 of the cleaning drum 40 so that the opening 60 of the drying drum is open. The locking flap 45 and the flap 51 remain in their positions shown in the drawing. During the unloading, air is sucked from the drying drum 41 into the suction conduit and to the activated charcoal filter.

It will be understood that each of the elements described above, or two or more together, may also find a useful application in other types of constructions differing from the types described above.

While the inventin has been illustrated and described as embodied in a method of and an arrangement for chemical cleaning, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dry-cleaning method for cleaning of textile and similar articles, comprising the steps of providing a cleaning chamber and a separate spaced-apart drying chamber which may be communicated with one another; cleaning the articles in the cleaning chamber while the same is out of communication with the drying chamber; establishing communication between the chambers and transporting the cleaned articles from the cleaning chamber into the drying chamber with a stream of air circulating in a closed path; interrupting communication between the chambers; and thereafter drying the transported articles in the drying chamber with said stream of air.

2. A dry-cleaning arrangement for cleaning of textile and similar articles, comprising means forming a first chamber for cleaning the articles; means forming a second separate chamber for drying the articles by air; means for selectively establishing and interrupting communication between said chambers so as to permit the cleaned articles to be transported from said first into said second chamber; air inducing means; an air passage communicating with both of said chambers and with said air inducing means; and means for causing a flow of induced air through said air passage into said first chamber when said chambers are in communication with one another so as to transport the cleaned articles from said first chamber into said second chamber, and for causing a flow of induced air to travel in a closed path through said second chamber when the communication between said chambers is interrupted so as to dry the cleaned articles.

3. The arrangement as defined in claim 2, wherein said means forming said chambers are rotatable drums.

4. The arrangement as defined in claim 3, wherein said establishing and interrupting means is a transport conduit communicating said drums with one another.

5. The arrangement as defined in claim 4, wherein said drums have axes and are located one above another and coaxial with one another, said transport conduit having an axis and being located coaxial with said drums.

6. The arrangement as defined in claim 4, wherein said drums have axes and are located one above another so that their axes are parallel to one another, said transport conduit having an axis parallel to the axes of said drums.

7. The arrangement as defined in claim 4, wherein said drums are laterally offset relative to one another, said transport conduit extending between said drums and having two spaced end portions each open in a respective one of said drums.

8. The arrangement as defined in claim 7, wherein said drums have axes and said end portions of said transport conduit have further axes, each of said end portions of said transport conduit being coaxial with a respective one of said drums.

9. The arrangement as defined in claim 4, wherein said transport conduit has a longitudinal axis and is turnable about said longitudinal axis; and further comprising means for turnably mounting said transport conduit.

10. The arrangement as defined in claim 9, wherein said transport conduit is turnable about said longitudinal axis in a stepped manner.

11. The arrangement as defined in claim 4, wherein said transport conduit is adapted to be offset relative to said drums so that the articles to be cleaned can be loaded into the arrangement in an offset position of said transport conduit.

12. The arrangement as defined in claim 11, wherein said drying drum has an inlet opening, said transport conduit being adapted to be offset about said inlet opening of said drying drum.

13. The arrangement as defined in claim 4, and further comprising means for preventing the flow of air from escaping out of the arrangement including sucking means, said establishing and interrupting means further including a flap member located in said transport conduit and separating the latter into two sections each communicating with said sucking means.

14. The arrangement as defined in claim 13, wherein said sucking means includes a suction air impeller.

15. The arrangement as defined in claim 14; and further comprising means for cleaning the sucked air operatively connected with said sucking means.

16. The arrangement as defined in claim 15, wherein said cleaning means includes a filter element.

17. The arrangement as defined in claim 16, wherein said filter element is an activated charcoal filter.

18. The arrangement as defined in claim 17; and further comprising an additional air passage selectively communicating said sections of said conduit with said air impeller and said filter element.

19. The arrangement as defined in claim 4, wherein said transport conduit has a flow cross-section increasing in the direction from said first chamber towards said second chamber.

20. The arrangement as defined in claim 2, wherein said chambers, said establishing and interrupting means, said causing means, and said air inducing means together form an air circulating and articles transporting circuit closed from outside.

21. The arrangement as defined in claim 2, wherein said means forming a first chamber is operative for cleaning the goods by a cleaning solution; and further comprising means forming, together with said means forming a first chamber, a closed circuit for recovering the cleaning solution.

22. The arrangement as defined in claim 21; and further comprising means located in said air passage and operative for directing the flow of air to travel through said recovering means.

23. The arrangement as defined in claim 22, wherein said directing means includes a flap located downstream of said air inducing means.

24. The arrangement as defined in claim 2, wherein said air inducing means includes an air impeller.

25. The arrangement as defined in claim 2, wherein said second chamber has a capacity exceeding the capacity of said first chamber.

* * * * *